US005790029A

United States Patent [19]

Curnutte et al.

[11] Patent Number: 5,790,029

[45] Date of Patent: Aug. 4, 1998

[54] EAS TAG PACKAGE

[75] Inventors: George E. Curnutte, Parkland; Dennis C. Gillette, Ft. Lauderdale; Norman B. Hansen, Highland Beach; Donald E. Gerstle, Boca Raton, all of Fla.

[73] Assignee: Sensormatic Electronics Corporation, Boca Raton, Fla.

[21] Appl. No.: 564,898

[22] Filed: Nov. 29, 1995

Related U.S. Application Data

[63] Continuation of Ser. No. 298,762, Aug. 31, 1994, abandoned.

[51] Int. Cl.[6] ..... G08B 13/14

[52] U.S. Cl. ..... 340/572; 340/551; 426/87; 426/231; 426/383

[58] Field of Search ..... 340/572, 551, 340/573, 870.17; 342/51, 239; 604/362; 128/653.1; 426/231, 87, 383

[56] References Cited

U.S. PATENT DOCUMENTS

| | | | |
|---|---|---|---|
| 3,493,955 | 2/1970 | Minasy . | |
| 3,836,842 | 9/1974 | Zimmermann et al. | 340/572 |
| 4,063,229 | 12/1977 | Welsh et al. | 340/571 |
| 4,510,489 | 4/1985 | Anderson, III et al. | 340/551 |
| 4,804,943 | 2/1989 | Soleimani | 340/539 |
| 4,811,000 | 3/1989 | Humphrey et al. | 340/572 |
| 4,992,794 | 2/1991 | Brouwers | 340/573 |
| 5,057,095 | 10/1991 | Fabian | 340/572 |
| 5,079,541 | 1/1992 | Moody | 340/572 |
| 5,081,446 | 1/1992 | Gill et al. | 340/572 |
| 5,218,342 | 6/1993 | McCrackin | 340/572 |
| 5,252,962 | 10/1993 | Urbas et al. | 340/573 |
| 5,253,821 | 10/1993 | Johnson | 340/572 |
| 5,291,180 | 3/1994 | Reed | 340/572 |
| 5,331,313 | 7/1994 | Koning | 340/572 |
| 5,357,240 | 10/1994 | Sanford et al. | 340/572 |
| 5,427,099 | 6/1995 | Adams | 128/653.1 |
| 5,583,489 | 12/1996 | Loemker et al. | 340/572 |

*Primary Examiner*—Jeffery A. Hofsass
*Assistant Examiner*—Benjamin C. Lee
*Attorney, Agent, or Firm*—Paul T. Kashimba; John J. Torrente

[57] ABSTRACT

An EAS tag package in which an EAS tag is enclosed within a sealed, thin-walled flexible bag.

23 Claims, 1 Drawing Sheet

EAS TAG PACKAGE

This is a continuation application under 37 CFR 1.62 of prior application Ser. No. 08/298,762, filed Aug. 31, 1994, now abandoned.

BACKGROUND OF THE INVENTION

This invention relates to electronic article surveillance ("EAS") tags and, in particular, to improvements in such EAS tags.

It is well-known to utilize EAS tags with articles to prevent theft. EAS tags usually include a detectable EAS sensor element which is incorporated into a housing or a support which is then affixed, attached or placed within the article to be protected. In some cases, the housing of the EAS-tag may surround or encapsulate the EAS sensor element.

An EAS tag is usually attached to an article to be protected by affixing or adhering the housing or support of the tag to the exterior surface of the article. While this has proved successful, alternative, less visible ways of incorporating EAS tags into various types of articles are still being sought. Alternatives are perhaps most difficult to put into effect for articles which contain foodstuffs or medicines, since inclusion of a tag on other than the exterior of such an article would likely require Food and Drug Administration (FDA) approval.

It is therefore an object of the present invention to provide an EAS tag package which is usable with articles containing foodstuffs and medicines.

It is a further object of the present invention to provide an EAS tag package which is better suited to receive FDA approval.

SUMMARY OF THE INVENTION

In accordance with the principles of the present invention, the above and other objectives are realized in an EAS tag package in which an EAS tag is enclosed within a sealed, thin-walled flexible bag. Preferably, the bag is formed of an FDA approved material.

With the tag package formed in this manner, it can be inexpensively manufactured. Also, the tag package can be safely inserted into various types of articles which contain foodstuffs and/or medicines.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
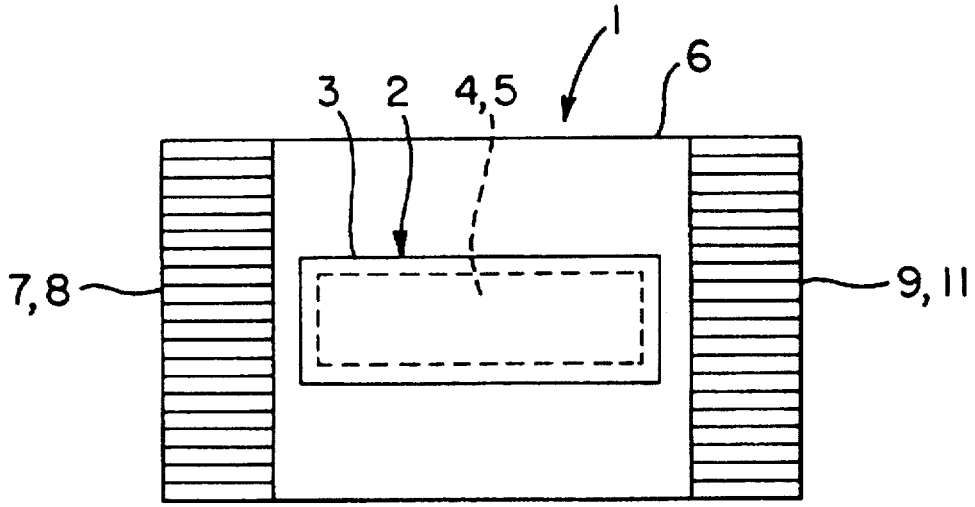
FIG. 1 shows a front plan view of an EAS tag package in accordance with the principles of the present invention.
Figure 2:
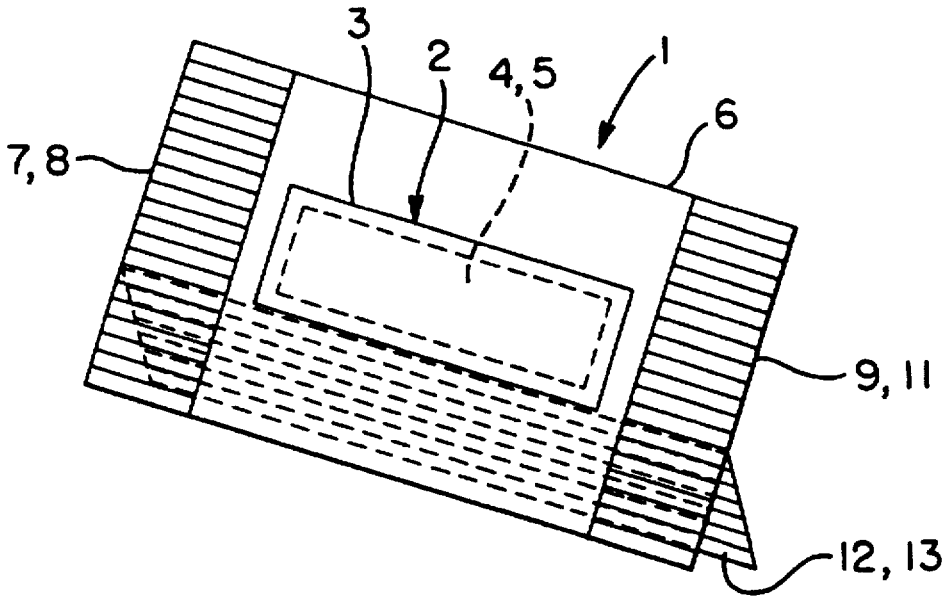
FIG. 2 shows a perspective view of the EAS tag package of FIG. 1.

FIGS. 1–2 illustrate an EAS tag package 1 in accordance with the principles of the present invention. The tag package 1 comprises an EAS tag 2 which can be any of the known types of EAS tags.

As shown, the EAS tag 2 is of a magneto-mechanical type described in co-pending application Ser. No. 07/962,274, assigned to the same assignee hereof. The EAS tag 2 thus comprises an outer, box-like closed housing 3 in which is disposed a magneto-mechanical element 4 and a magnetic biasing element 5. These elements cooperate to generate a detectable signal in the manner disclosed in the U.S. Pat. No. 4,510,489, the teachings of which are incorporated herein by reference.

In accordance with the principles of the invention, the EAS tag package 1 further comprises, a flexible, thin-walled bag 6 which is sealed to totally enclose the EAS tag 2. The bag 6 preferably comprises an FDA-approved material. Particular materials might be certain types of thin plastics and cellophanes. Specific materials are as follows: polyethylene, polypropylene, polyvinylchloride ("IPVC"), polyethylene-terephthalate ("PET"), nylon, polyester, polystyrene and ionomer.

As shown, the bag 6 has been formed by heat sealing a cellophane material along abutting vertical sides 7, 8 and 9, 11 and along abutting horizontal sides 12 and 13. This forms the bag 6 in a manner which totally encloses the tag 2, as above-described.

With the EAS tag package 1 configured as aforesaid, the package can be easily and inexpensively manufactured. Moreover, because the material of the bag 6 is an FDA-approved material, the package 1 can be safely inserted into articles containing food and/or medicines.

While the tag package 1 has been illustrated as comprised of a magneto-mechanical EAS tag 2, the EAS tag 2 can also be of the magnetic type as disclosed in U.S. Pat. No. 4,660,025. Moreover, the EAS tag 2 can be of a radio frequency and/or a microwave frequency resonant circuit type as disclosed in U.S. Pat. No. 4,063,229.

The bag 6 of the package 1 can be formed in various ways, as long as the resultant bag totally encloses the tag 2. Thus, a variety of thin walled, flexible materials seamed in any manner to form an enclosure or bag can be used to realize the bag 6.

In all cases it is understood that the above-described arrangements are merely illustrative of the many possible specific embodiments which represent applications of the present invention. Numerous and varied other arrangements can be readily devised in accordance with the principles of the present invention without departing from the spirit and scope of the invention.

What is claimed is:

1. In combination:

one of a food and drug container;

an EAS tag package inserted in said container comprising: a sealed, thin-walled bag, said bag comprising an FDA-approved material;

and a detectable EAS tag disposed within said bag.

2. The combination in accordance with claim 1 wherein:

said EAS tag comprises a magneto-mechanical element.

3. The combination in accordance with claim 2 wherein:

said EAS tag further comprises a housing for said magneto-mechanical element.

4. The combination in accordance with claim 3 wherein:

said EAS tag further comprises a bias element for biasing said magneto-mechanical element.

5. The combination in accordance with claim 4 wherein:

said sealed bag comprises a plastic material.

6. The combination in accordance with claim 4 wherein:

said sealed bag comprises a cellophane material.

7. The combination in accordance with claim 4 wherein::

said sealed package comprises one of polyethylene, polypropylene, PVC, PET, nylon, polyester, polystyrene and ionomer.

8. The combination in accordance with claim 1 wherein:

said EAS tag comprises a magnetic element.

9. The combination in accordance with claim 8 wherein:

said EAS tag further comprises a support for said magnetic element.

10. The combination in accordance with claim 9 wherein:

said sealed bag comprises a plastic material.

11. The combination in accordance with claim 9 wherein:

said sealed bag comprises a cellophane material.

12. The combination in accordance with claim 9 wherein:

said sealed bag comprises one of polyethylene, polypropylene, PVC, PET, nylon, polyester, polystyrene and ionomer.

13. The combination in accordance with claim 1 wherein:

said EAS tag comprises a resonant circuit adapted to be responsive to microwave frequency signals.

14. The combination in accordance with claim 13 wherein:

said EAS tag further comprises a support for said resonant circuit.

15. The combination in accordance with claim 14 wherein:

said sealed bag comprises a plastic material.

16. The combination in accordance with claim 14 wherein:

said sealed bag comprises a cellophane material.

17. The combination in accordance with claim 14 wherein:

said sealed bag comprises one of polyethylene, polypropylene, PVC, PET, nylon, polyester, polystyrene and ionomer.

18. The combination in accordance with claim 1 wherein:

said sealed bag comprises a plastic material.

19. The combination in accordance with claim 1 wherein:

said sealed bag comprises a cellophane material.

20. The combination in accordance with claim 1 wherein:

said sealed bag comprises one of polyethylene, polypropylene, PVC, PET, nylon, polyester, polystyrene and ionomer.

21. An EAS tag in accordance with claim 1, wherein:

said EAS tag comprises a resonant circuit adapted to be responsive to radio frequency signals.

22. An EAS tag in accordance with claim 1, wherein:

said EAS tag comprises a resonant circuit adapted to be responsive to radio frequency and microwave frequency signals.

23. An electronic article surveillance device for use in a food or drug container, said device comprising:

(a) an electronic article surveillance tag; and (b) a sealed, thin-walled package comprising an FDA-approved material for contact with food or drugs surrounding said tag.

* * * * *

UNITED STATES PATENT AND TRADEMARK OFFICE

CERTIFICATE OF CORRECTION

PATENT NO : 5,790,029

DATED : August 4, 1998

INVENTOR(S) : Curnutte, et al

It is certified that error appears in the above-identified patent and that said Letters Patent is hereby corrected as shown below:

Column 1, line 17, change "EAS-tag" to --EAS tag--.

Column 2, line 12, change "('IPVC")" to --("PVC")--.

Column 2, line 64, delete second ":".

Column 4, line 14, change "An EAS tag" to --The combination--.

Column 4, line 17, change "An EAS tag" to --The combination--.

Signed and Sealed this

Sixth Day of October, 1998

Bruce Lehman

*Attest:*

BRUCE LEHMAN

*Attesting Officer*

*Commissioner of Patents and Trademarks*